US006520498B2

(12) United States Patent
Phinney

(10) Patent No.: US 6,520,498 B2
(45) Date of Patent: Feb. 18, 2003

(54) METHOD AND APPARATUS FOR DETECTION OF WRINKLED DOCUMENTS IN A SHEET FEEDING DEVICE

(75) Inventor: Daniel P. Phinney, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/746,049

(22) Filed: Dec. 21, 2000

(65) Prior Publication Data

US 2002/0079644 A1 Jun. 27, 2002

(51) Int. Cl.[7] ..... B65H 7/12

(52) U.S. Cl. ..... 271/263; 271/258.01; 271/265.01; 367/13; 327/244

(58) Field of Search ..... 271/258.01, 263, 271/265.01; 367/124, 125, 13; 327/244

(56) References Cited

U.S. PATENT DOCUMENTS 3,763,483 A * 10/1973 Urmenyl ..... 340/675
4,066,969 A 1/1978 Pearce et al.
4,691,100 A * 9/1987 Kizu et al. ..... 250/223 R
4,724,481 A * 2/1988 Nishioka ..... 348/133
4,845,761 A * 7/1989 Cate et al. ..... 382/101
4,975,971 A * 12/1990 Ohnishi ..... 382/112
5,971,388 A 10/1999 Hattori et al.

* cited by examiner

*Primary Examiner*—H. Grant Skaggs
(74) *Attorney, Agent, or Firm*—James R. Burdett; Nelson Adrian Blish

(57) ABSTRACT

An apparatus and method for detecting wrinkling of sheets of material is provided. A change in an angle the sheet forms with a reference line can be detected. When the change in the angle exceeds a threshold value, wrinkling of the sheet can be detected. In an exemplary embodiment, ultrasound signals may be used to detect wrinkling. As ultrasound passes through a sheet of material, for example, paper, there is both a phase shift and an amplitude reduction to that ultrasound signal. As the angle of the sheet changes with respect to the ultrasound signal due to wrinkling of the sheet, the phase shift and amplitude of the signal after it passes through the sheet changes. Thus, as the sheet begins to wrinkle, there is a change in the phase shift and amplitude of the signal. These changes can be used to detect the start of a document jam or wrinkling of a sheet of material.

21 Claims, 8 Drawing Sheets

METHOD AND APPARATUS FOR DETECTION OF WRINKLED DOCUMENTS IN A SHEET FEEDING DEVICE

CROSS REFERENCE TO RELATED APPLICATIONS

Reference is made to commonly-assigned copending U.S. patent application Ser. No. 09/573,914, filed May 18, 2000, entitled A METHOD AND APPARATUS FOR CORRECTING A PHASE SHIFT BETWEEN A TRANSMITTER AND RECEIVER, by Daniel P. Phinney et al.; U.S. patent application Ser. No. 09/567,896, filed May 10, 2000, entitled A METHOD AND APPARATUS FOR DETERMINING A DIGITAL PHASE SHIFT IN A SIGNAL, by Daniel P. Phinney et al. and now U.S. Pat No. 6,407,599; U.S. patent application Ser. No. 09/552,064, filed Apr. 19, 2000, entitled A METHOD AND APPARATUS FOR MULTIPLE DOCUMENT DETECTION USING ULTRASONIC PHASE SHIFT AND AMPLITUDE, by Daniel P. Phinney et al., the disclosures of which are incorporated herein.

FIELD OF THE INVENTION

This invention relates in general to transports for sheets of material and in particular, to detecting the wrinkling of the sheets.

BACKGROUND OF THE INVENTION

Document scanners, copiers, fax machines, photographic film machines and newspaper processing machines use feeders to transport sheets of material. Mechanisms used for the transportation of the sheets of material, which may include paper, documents, film, etc., have the capacity to wrinkle these sheets. It is necessary to determine when a sheet of material starts to wrinkle in a transport so the transport may be stopped quickly before the sheet is damaged.

The present methods used to detect jams and wrinkling of sheets of material involve measuring the time the sheet of material takes to move through the transport. Various check points are distributed along the transport. During normal processing, the sheet is expected to pass these check points at specified times. If the sheet is late arriving at one of these checkpoints used for timing, the assumed there is a jam, the sheet is wrinkling or another error has occurred. The document transport is then stopped. The timing method does not stop transport of the sheet quickly and normally results in one or more documents being seriously damaged or a serious jam with possible physical damage to the sheet of material or transport.

In solving a related problem with transports for sheets of material, ultrasonic signals are used to detect feeding multiple sheets with the transport. This non-contact method for the detection of feeding multiple sheets with a transport sends ultrasound signals through the document while monitoring the ultrasound after it has passed through the document. Sending ultrasound through sheets of material, for example, paper, results in attenuation and phase shift of the ultrasound signal. It is possible to determine the feeding multiple documents by measuring the phase shift and/or amplitude of the ultrasound signal passing through documents. For example, U.S. Pat. No. 4,006,969, which is incorporated herein by reference, describes an apparatus for detecting multiple sheets using ultrasound. As ultrasound passes from a ultrasonic transmitter through the documents and to an ultrasonic receiver, the phase of the signal changes, depending on the wavelength and the distance. Ultrasonics offers the advantage of making no contact with the paper and being relatively independent of the paper thickness.

Accordingly, there is a need for a method and apparatus that can detect wrinkling of a sheet of material independent of the sheet thickness. Also, there is a need for a system which can quickly detect a jam or wrinkling of a sheet of material before the sheet is seriously damaged. The method and apparatus should also allow the detection of wrinkling at the leading edge of the sheet as its starts to wrinkle.

SUMMARY OF THE INVENTION

A method and apparatus for detecting wrinkling of sheets of material is provided. A signal can be transmitted through the sheet. After the signal has passed through the sheet, it is received by, for example, a receiver. The generated signal may then be compared to the received signal. Wrinkling in the sheet can be determined based on the comparison.

In an exemplary embodiment, a document transport system transports a document along a feed path. A desired angle the document forms with the feed path during normal operation can be determined. An actual angle the document forms with the feed path may also be determined. A difference between the desired angle and the actual angle can then be determined. A document jam in the transport system may be detected when the difference exceeds a predetermined threshold.

In a further embodiment, a sheet is fed along a feed path with a mechanism. A signal may be transmitted through the sheet as it passes along the feed path. The signal is received after it passes through the sheet. A phase difference between the transmitted signal and the received signal can be detected. Also, an amplitude difference between the transmitted signal and the received signal can be detected. Wrinkling of the sheet can be determined based on at least one of the phase difference and the amplitude difference. If wrinkling is detected, the feeding of the sheet should be halted.

According to one embodiment of the present invention, an apparatus for the detection of wrinkling documents comprises an ultrasonic transmitter for transmitting an ultrasonic signal. An ultrasonic receiver receives the ultrasonic signal, which passes through the document in the document transport. A phase comparator compares the transmitted ultrasonic signal and the received ultrasonic signal, and an amplitude measurement circuit compares the received ultrasonic signal to a reference. A microprocessor compares an information signal from the phase comparator and an information signal from the amplitude measurement circuit to a threshold to determine if the document is starting to wrinkle.

This invention can use both phase shift and amplitude variation of ultrasound passed through a document stream to determine start of the wrinkling of a document. By using both phase shift and amplitude of the signal, the start of a wrinkling can be accurately detected. Using ultrasonics allows this information to be determined without physically contacting the paper.

This invention can offer the advantage of making no contact with the paper. By using both the phase and amplitude change of the received ultrasound, the start of the wrinkling of a document can be detected more reliably than is possible by using phase detection alone or amplitude detection alone. It is possible to implement this invention using only the phase or the amplitude detection.

DETAILED DESCRIPTION OF THE INVENTION

An apparatus and method for detecting wrinkling of sheets of material is provided. A change in an angle the sheet forms with a reference line can be detected. When the change in the angle exceeds a threshold value, wrinkling of the sheet can be detected.

In an exemplary embodiment, ultrasound signals may be used to detect the change in angle and wrinkling. As ultrasound passes through a sheet of material, for example, paper, there is both a phase shift and an amplitude reduction to that ultrasound signal. As the angle of the sheet changes with respect to the ultrasound signal due to wrinkling of the sheet, the phase shift and amplitude of the signal after it passes through the sheet changes. Thus, as the sheet begins to wrinkle, there is a change in the phase shift and amplitude of the signal. These changes can be used to detect the start of a document jam or wrinkling of a sheet of material.

Furthermore, the method and apparatus of the present invention can be used to detect if a sheet of material meets certain quality control standards. An ultrasound signal can pass through a sheet of material. A phase shift and change in amplitude of the signal after it passes through the sheet can be detected. If the phase shift and/or change in amplitude are beyond a certain range, the sheet can be detected as flawed, for example, for being wrinkled or having other surface imperfections.

Figure 1:
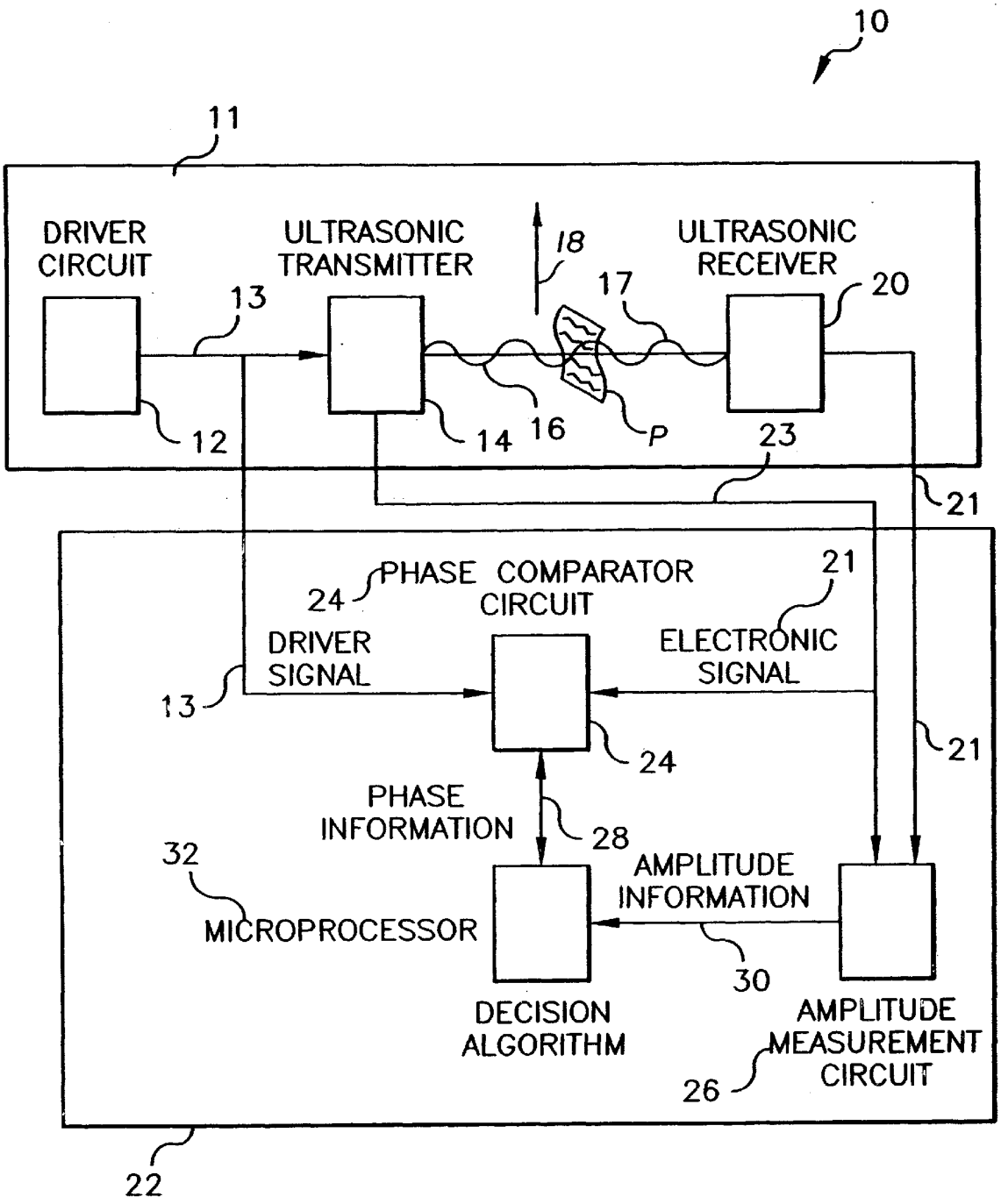
FIG. 1 is a block diagram of a wrinkling detection apparatus according to an embodiment of the invention.

FIG. 1 shows an apparatus 10 for detecting wrinkling of sheets of material in accordance with one embodiment of the present invention. The apparatus may include a signaling system 11 and an analyzer 22. The signaling system can transmit a signal to and receive the signal from a feed path 18 along which the sheet travels. The analyzer may determine if a sheet of material is beginning to wrinkle in response to at least one of a phase shift and an amplitude change between the transmitted signal and the received signal.

In this particular embodiment, the signaling system 11 includes an ultrasonic drive circuit 12, an ultrasonic transmitter 14, and an ultrasonic receiver 20, although other types of signaling systems with other components and operating in other frequency ranges or using other signals, such as electromagnetic signals, can be used. The ultrasonic drive circuit 12 can provide a drive signal 13 to the ultrasonic transmitter 14. In response, the ultrasonic transmitter 14 can produce an ultrasonic signal 16. Signal 16 can pass through a feed path 18 and a sheet of material to become an ultrasonic signal 17. Signal 17 should have a different phase and amplitude, than the transmitted signal and should be received by the ultrasonic receiver 20. The ultrasonic receiver 20 preferably converts the received ultrasonic signal 17 into an electrical signal 21. This resulting electrical signal 21 can be conditioned and processed to interpret the amplitude and the phase information of the received ultrasonic signal 17. The amplitude and phase information of signal 16 can be compared with amplitude and phase information of signal 17. Based on this comparison, it can be determined if the sheet is wrinkling.

According to one embodiment of the invention, the analyzer 22 may include a phase comparator 24, an amplitude measurement circuit 26, and a microprocessor 32. Of course, other types of analyzers which can analyze phase and amplitude changes in a signal can be used. The electronic signal 21 can be supplied to an input of the phase comparator 24 and to an input of the amplitude measurement circuit 26. The resulting amplitude and phase information may be used to make a determination if a sheet of material is wrinkling, as is described in more detail below.

The ultrasonic signal 16 can experience a phase shift as it passes through feed path 18 and the sheet of material P. The phase shift is relatively independent of the thickness of the sheet in the feed path 18. Instead, the phase shift experienced by the received ultrasonic signal 17 may depend on an angle between the sheet of material and the transmitted signal 16. Thus, as the angle of the sheet changes with respect to the transmittal signal 16 due to wrinkling, the phase and/or amplitude of the received signal 17 should also change. When a change beyond a threshold or outside a range is detected, wrinkling of the sheet is detected. If the sheet is being fed with a transport, the feeding of the sheet is preferably immediately stopped. Damage to the sheet can be prevented by quickly detecting wrinkling.

Also, the method and apparatus can be used to check the quality of a sheet of material. A signal can be impinged on an acceptable sheet. Base phase and/or amplitude changes of the signal for the acceptable sheet can be determined. The phase and/or amplitude changes of a signal impinged on a particular sheet can then be compared to the base changes for the acceptable sheet. If the phase and/or changes for any sheet differ from those for the acceptable sheet or fall outside a predetermined range, surface imperfections, such as wrinkling, may be detected.

The transmitter 14 can be arranged to impinge its signal on the sheet P at virtually any angle. Preferably, the signal 16 is orthogonal to feed path 18. The change in phase or phase difference in the received ultrasonic signal 17 can be determined by comparing the electronic signal 21, which contains information based on the phase shift, and the drive signal 13, which should be directly related to the phase of the transmitted ultrasonic signal 16. The phase comparator 24 can compare these signals and can provide an information signal 28 indicating the wrinkling of sheets of material based on the detected phase shift.

The amplitude change may be obtained by comparing the received ultrasonic signal 17, which is represented by electrical signal 21, against the amplitude of the transmitted ultrasonic signal 16, which is represented by electrical signal 23. A larger decrease in amplitude between the received and the transmitted ultrasonic signals 16 and 17 usually indicates wrinkling of the sheets. The amplitude measurement circuit 26 can provide an amplitude information signal 30 with an amplitude change dependent on the change of the angle of the sheet with respect to the signal, indicating wrinkling.

The information signal 28 from phase comparator 24 and the amplitude information signal 30 from the amplitude measurement circuit 26 may both be fed to a microprocessor 32. The microprocessor 32 can monitor information signal 28 and information signal 30 to determine if the sheet angle of the sheet is changing and it is wrinkling. In the preferred embodiment, both information signal 28 and information signal 30 must indicate wrinkling before the microprocessor 32 indicates a wrinkled sheet. In alternate embodiments, microprocessor 32 may be programmed to indicate wrinkled sheets in the feed path 18 if either the phase information signal 28 or the amplitude information signal 30 indicates wrinkled sheets in the feed path 18.

In yet another embodiment, a weighting factor may be assigned to each information signal 28 and 30. A decision algorithm employed by the microprocessor 32 can apply the weighting factor to each information signal 28 and 30 and then determine if sheets in the feed path 18 are wrinkled. In an exemplary embodiment, the decision algorithm is phase time W1 plus amplitude time W2 wherein W1 and W2 are predetermined values. Of course, other algorithms can be used. Also, the particular weighting factors used for each information signal 28 and 30 can vary as needed based on a variety of factors, such as the thickness of the sheets of material and the angle of transmitted signal 16.

Use of both amplitude and phase information from an ultrasonic signal transmitted through sheets of material can results in a more accurate detection system. Additionally, the system in accordance with the present invention requires no contact with the documents, so the system is unlikely to jam or otherwise mar the sheets.

In this particular embodiment, the transmitted signal 16 is an ultrasound signal, although other frequencies can be used. Ultrasonic is useful for detecting the presence or thickness of paper and other materials. As ultrasound, sound at ultrasonic frequencies, passes through a sheet of material, such as paper, it undergoes both a phase shift and an amplitude reduction. The present invention can use these changes to detect the wrinkling of a document.

Figure 2:
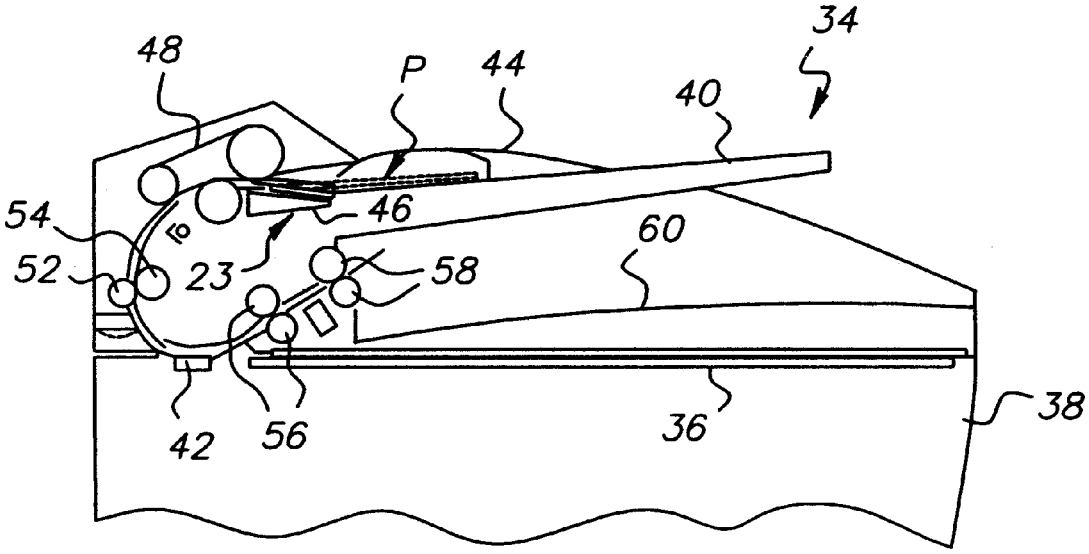
FIG. 2 is a perspective view of a typical transport system.

Referring now to the drawings, and more particularly to FIG. 2 thereof, there is shown a cross-sectional view of one embodiment of a document feeding device 34. This device 34 is provided in an openable and closable manner relative to a contact glass 36 provided on an upper plane of a copying machine 38. The document feeding device is constructed to separate a plurality of sheets of a document P, which have been placed on a setting stand or tray 40, sheet by sheet and automatically feed the sheets to a slit glass 42 through which the sheets are read or scanned. While the feeding device 34 is described with respect to the copying machine 38, the feeding device 34 is equally applicable to facsimile machines, scanners, or any device which utilizes a feeder.

A pair of side fences 44 are provided on the setting stand 40 (only the side fence 44 at the front end is shown in FIG. 2), and the side fences 44 secure a positioning of the document P in its width direction. Also, a push-up plate 46 is provided on the left side of the setting stand 40 (the front end side of the setting document P). The push-up plate 46 is constructed to push up front ends of the sheets of the document P so that the sheets of the document P contact a lower end of a feeding belt 48. When in this position, referred to as a predetermined feeding position, the sheets are clamped between the feeding belt 48 and the bottom sheet of the document contacts the push-up plate 46. Alternatively, the feeding belt 48 can be replaced by feeding roller. In this embodiment, the original setting stand 40 and the push-up plate 46 constitute a receiving/piling unit for piling and housing a plurality of sheets of the document P.

The feeding belt 48 is constructed to feed the sheets of the document P which have been pushed up by the push-up plate 46, and the sheets of the original document P which have been fed by this feeding belt 48 are separated by a separating roller 50 in such a manner that only a top sheet of the document P at the uppermost position is separated and fed.

This separated sheet of the document P is guided by a pair of conveying rollers 52 through a feeding path 54 to the slit glass 42 which constitutes a reading or scanning position of the sheets of the document P. The separated sheets is then exposed to the light on this slit glass 42 by an exposure device which is not shown in the figures in order to read or scan the sheet. The sheet of the document P which has been read or scanned is then conveyed rollers 56 and a pair of discharging rollers 58, and is then discharged onto an original document discharging tray 60.

As is clear from the above description of the document feeding device, there are many components used to transport the documents. Consequently there are many opportunities for wrinkling or jamming of the document. Accordingly, transmitters and receivers for detecting wrinkling may be distributed at various places along the feed path. The transmitters and receivers are preferably placed to detect wrinkling as it begins at the leading edge of the document. Thus, they should be placed before components that can cause jams and wrinkling.

Figure 3:
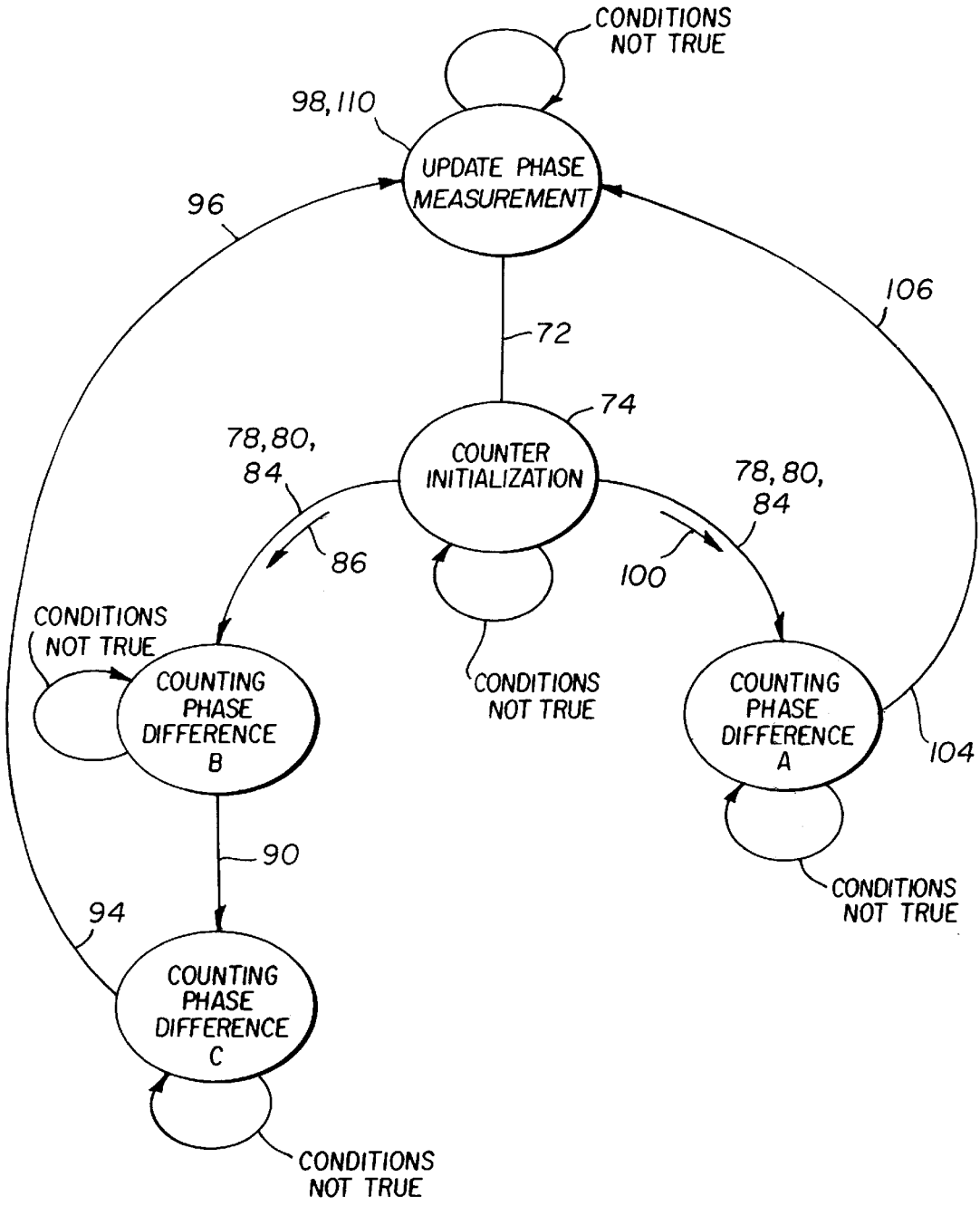
FIG. 3 is a state diagram of an algorithm used for determination of phase shift according to an embodiment of the invention.
Figure 4A:
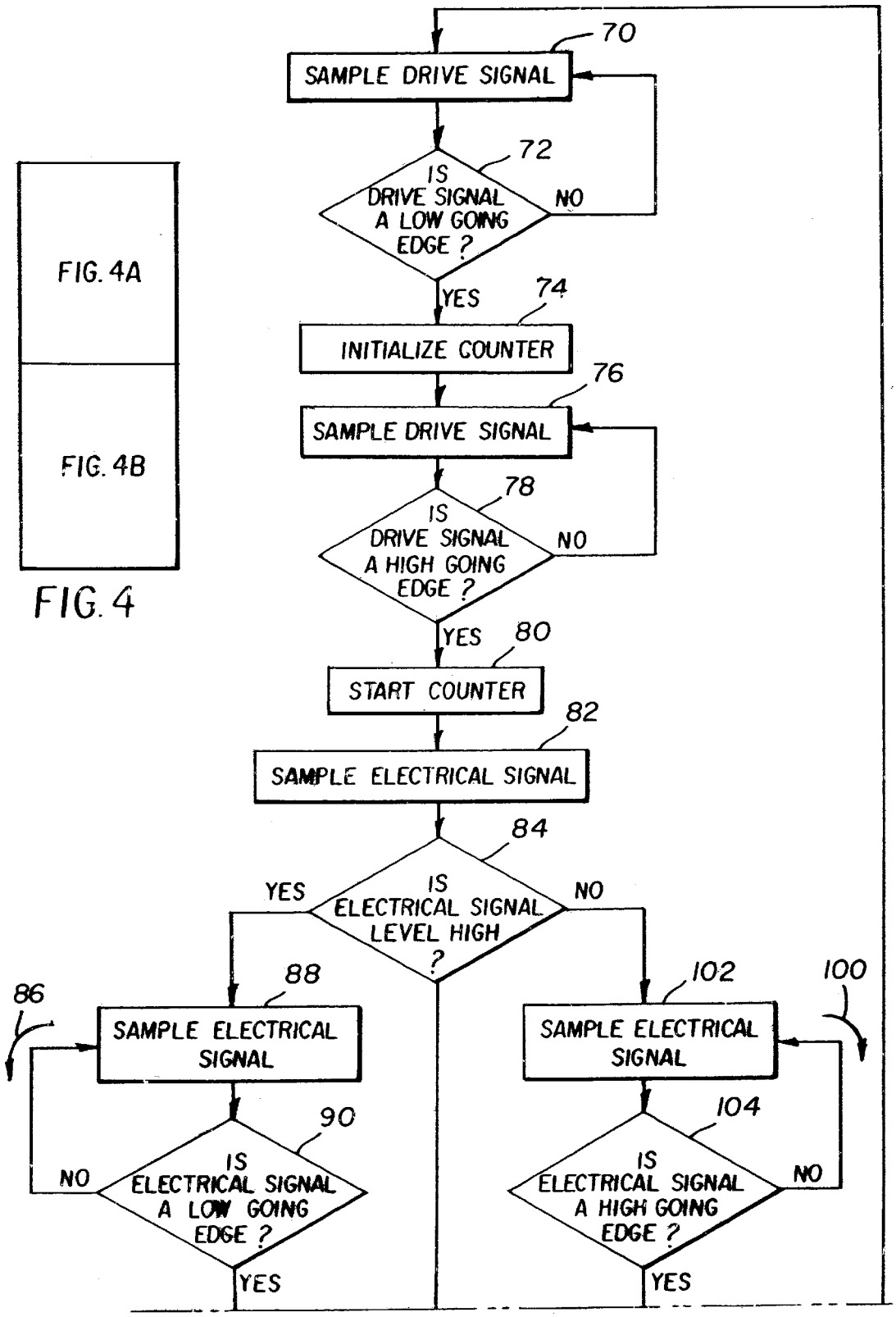
FIGS. 4, and 4B show a flow chart for phase shift detection of the state diagram of FIG. 3.
Figure 4B:
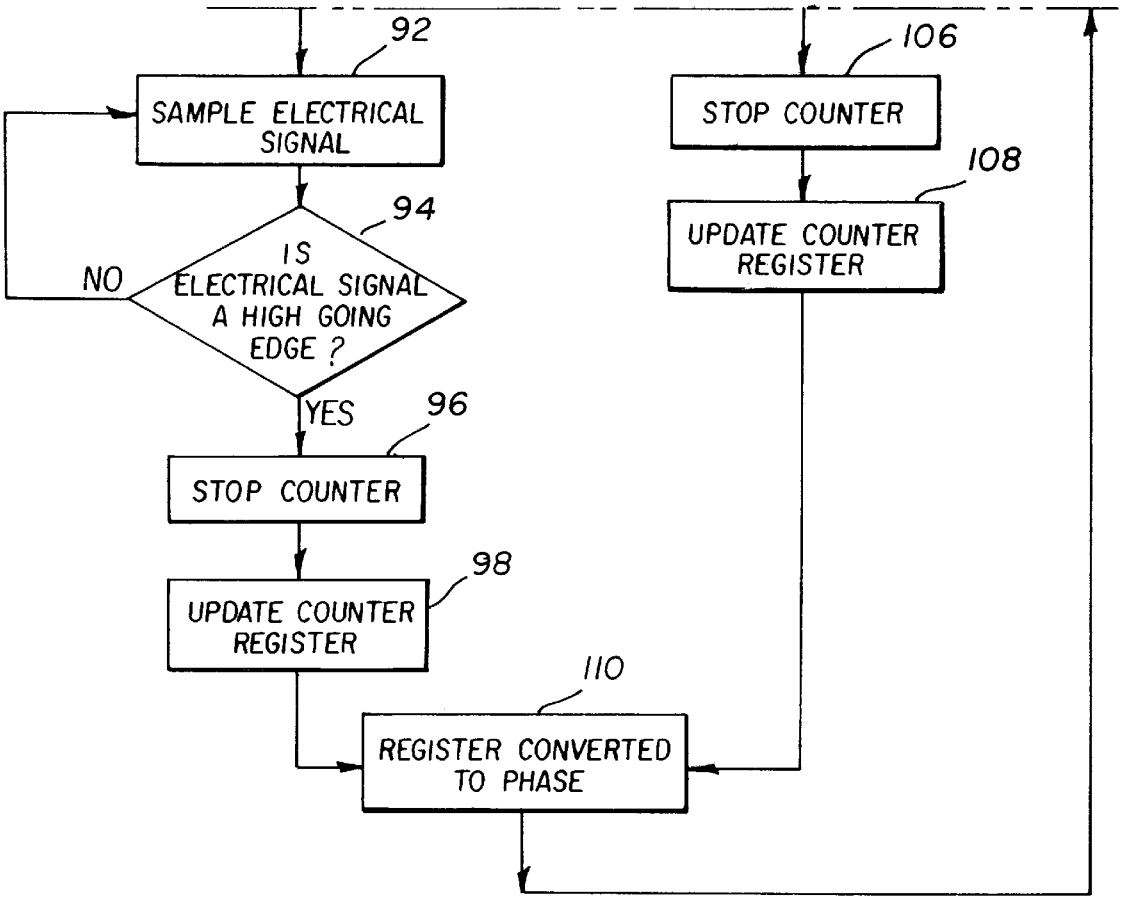
Figure 5:
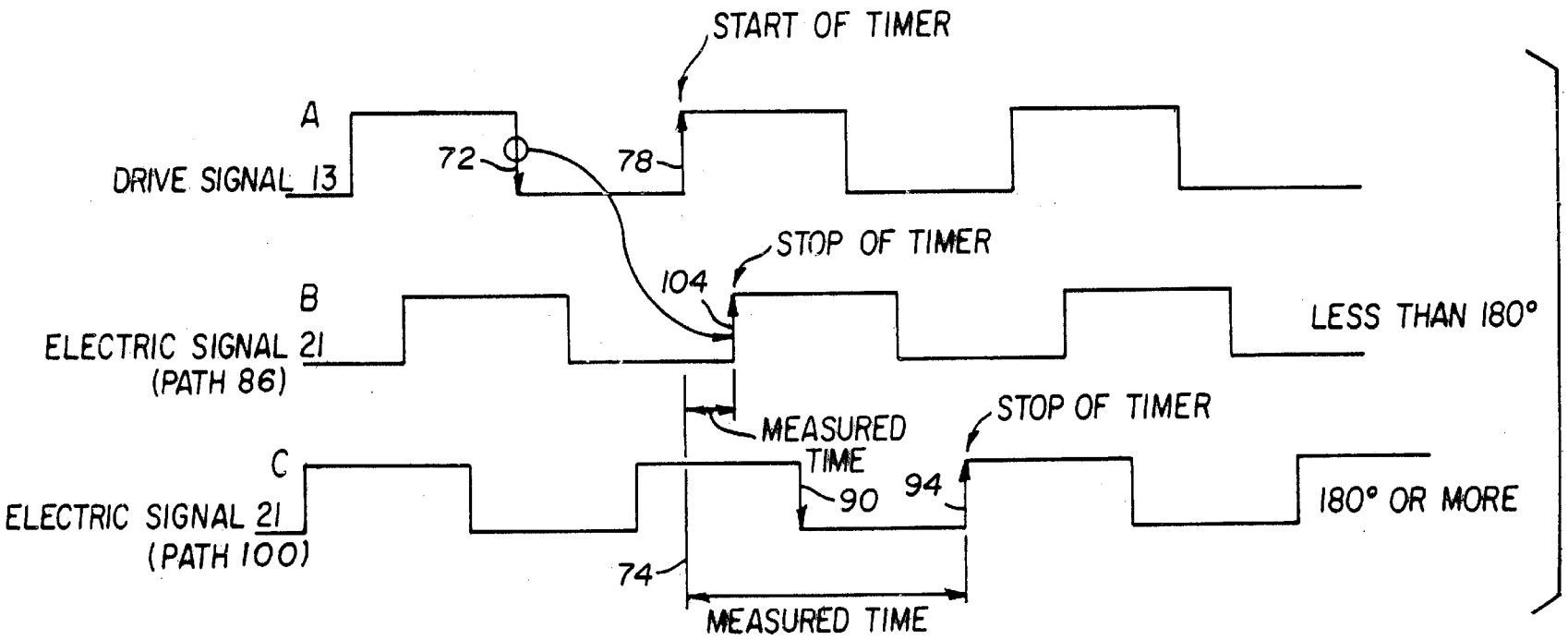
FIG. 5 shows waveforms with phase shifts.

Various methods of determining the phase shift between the transmitted signal and received signal are available. Referring to FIGS. 3–5, a preferred method in accordance with one embodiment of the present invention for determining a digital phase shift in a signal will be described. In this particular embodiment, the drive signal 13 is used as a reference signal and is sampled 70. If a low going level is detected 72 the counter is initialized 74. If a lower going edge is not detected the drive signal is sampled again the method returns to step 70.

After the counter is initialized, the drive signal is sampled again 76. If a high going edge is not detected in step 78, the method returns to step 76 and drive signal 13 is resampled. When a high going edge is detected in step 78 the counter is started 80.

The electrical signal 21 is sampled per step 82. If the electrical signal level is at a high level, path 86 is selected and the electrical signal 21 is sampled 88. If a low going edge is not detected in step 90, sampling continues per step 88. When a low going edge is detected in step 90 sampling of the electrical signal 21 continues per step 92.

The reason for detecting a low going edge is shown by reference to waveform A and waveform C in FIG. 5. Since the level of the electric signal is high there is the possibility that the high going edge of the electric signal 21 and the drive signal 13 could coincide so the first low going edge must be detected, which is shown schematically by the total measured time. Thus, phase differences greater than one half cycle may be measured.

Sampling of the electrical signal 21 continues at step 92 until a high going edge is detected 94. At this point the counter is stopped per step 96 and the counter register value is updated at 98. If a high going edge is not detected in step 94, the electrical signal 21 is resampled in step 92. The counter register 98 is converted to an actual phase value by a microprocessor in step 110 and returning to step 70 the drive signal is again sampled for a low going edge.

If in step 84 the electrical level is not high, path 100 is selected and the electrical signal is sampled in step 102 for a high going edge. When a high going edge is detected in step 104, the counter is stopped and the counter register is updated per steps 106, 108. If a high going edge is not detected in step 104, the electrical signal is resampled in step 102. When the counter register is updated in step 108, paths 86 and 100 merge back together and the register is converted to a phase value by the microprocessor in step 110 and the method may return to step 70 where drive signal is again monitored for a low going edge.

In summary, if the electrical signal 21 is low, the phase difference is represented by the time until the electrical signal 21 goes high. If the electrical signal 21 is high when the drive signal 13 goes high, the phase difference is represented by the time until the electrical signal 21 goes low and then high again.

The algorithm shown by the state diagram in FIG. 3 will handle the situation where the electrical signal 21 is either leading or lagging the drive signal 13 by 180 degrees or less. Although in this particular embodiment, triggering events comprise detected low going and high going edges as described above, it would be readily apparent to one of ordinary skill in the art that other triggering events could also be used, such as switching all of the triggering events for low going edges to high going edges and all of the triggering events for high going edges to low going edges.

Figure 7:
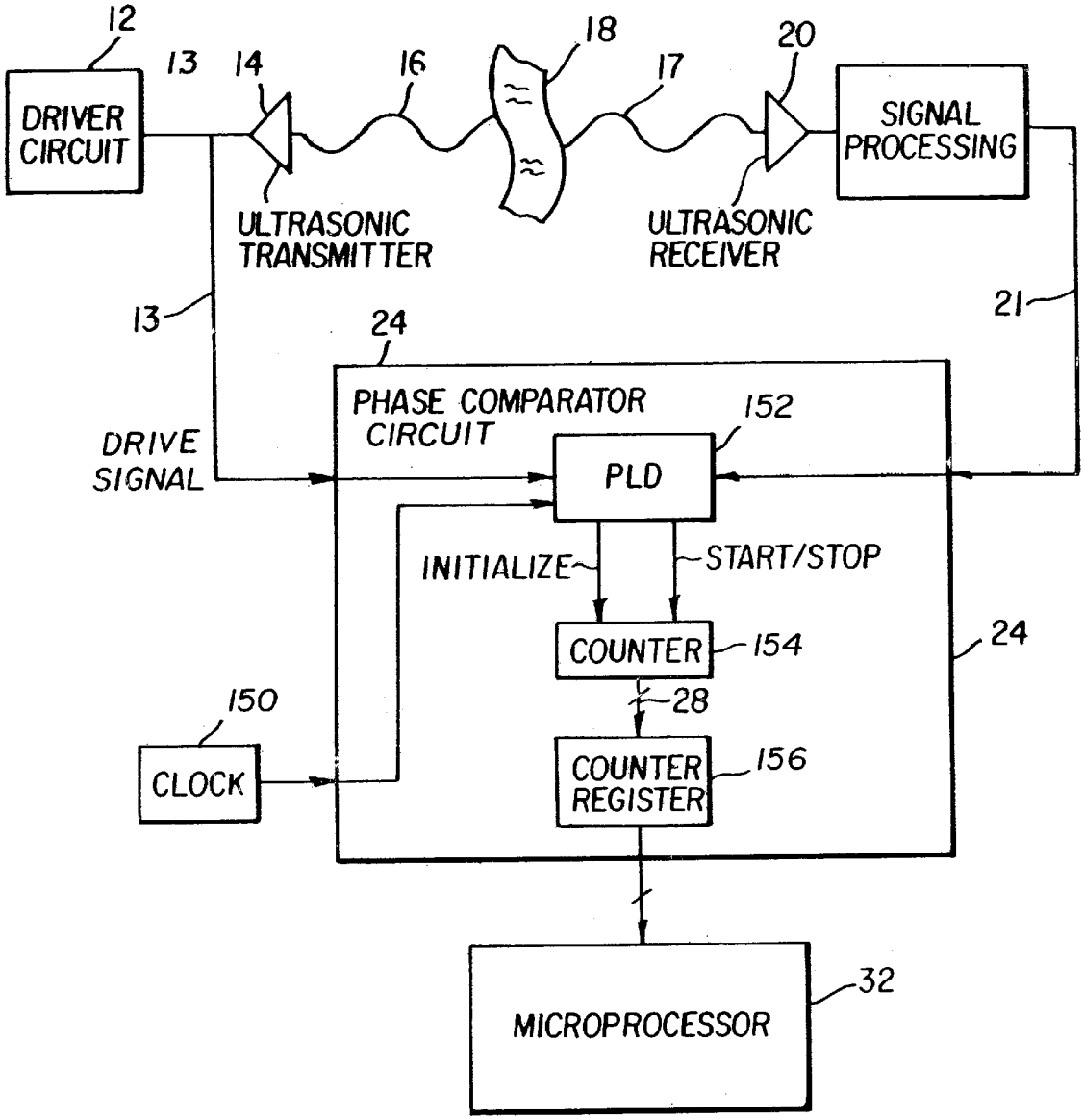
FIG. 7 is a block diagram of a detection apparatus including a detail of a phase comparator circuit according to an embodiment of the invention.

In this particular embodiment, a clock 150 shown in FIG. 7 can control the sample rate. Using a faster clock will increase the sample rate and hence the resolution and accuracy. The counter measures the number of clock pulses. Since a digital value of the time difference is obtained by reference to the counter, this value can be input directly into a microprocessor 32 or any digital logic unit for easy processing. This method will provide a full 360 degrees of phase shift measurement before phase wrap around occurs.

Figure 6:
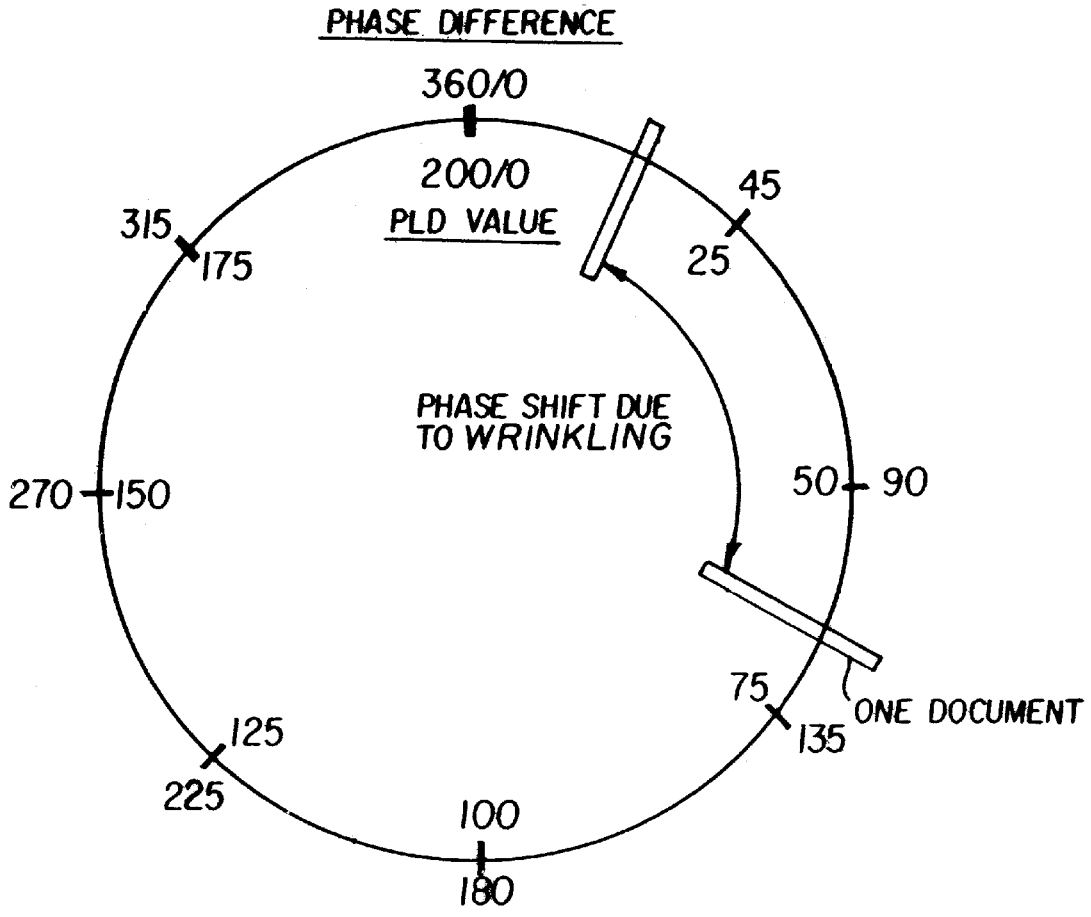
FIG. 6 is a schematic diagram of a phase shift.

As applied to detection of wrinkling of documents, the phase shift indicates a change in the angle of the document with respect to the transmitted signal. Referring now to FIG. 6, essentially no phase shift will occur when no documents are present in the feed path. The presence of one document, such as a sheet of paper, may cause a phase shift of approximately 90 degrees. A number of factors cause variation in the exact phase difference, some of which include thickness of the documents, angle of the transmitter and receiver, and angle of the document within the ultrasound path. Thus, the change in phase required for detecting wrinkling will vary upon the particular situation. In an exemplary embodiment in a document transport system, change in phase of 20°–100° may indicate wrinkling of the document or a jam.

FIG. 7 shows additional details of the phase comparator 24 in accordance with another embodiment of the present invention. In this particular embodiment, the programmable logic device (PLD) 152 incorporates the algorithm shown in FIG. 3. The PLD starts and stops counter 154 according to the criteria described above with reference to FIGS. 4A and 4B. The counter values are transferred to the counter register 156 at the completion of a phase measurement cycle. Microprocessor 32 periodically samples counter register 156. The rate of sampling by the microprocessor 32 may be set at different values however, for example, a low volume document transport system may sample 2000 times per second. Clock 150 provides a sample rate signal to counter 154 and PLD 152. The rate of clock 150 may sample at a rate of 32 μsec, although other clock rates are available as described above. As the above-described method and system illustrate, the phase shift difference between the drive signal 13 and the electrical signal 21 can be obtained without any analog processing, using only digital methods. As a result, the present invention is simpler and can be implemented less expensively and with greater precision than prior analog systems for measuring phase shift differences between signals.

Accordingly, a method and apparatus for detecting wrinkling or surface imperfections of a sheet of material is provided. Changes in the phase and amplitude of a signal impinging on the sheet can be detected. Evaluating these changes can indicate wrinkling of the sheet.

The embodiments illustrated and discussed in this specification are intended only to teach those skilled in the art the best way known to the inventors to make and use the invention. Nothing in this specification should be considered as limiting the scope of the present invention. The above-described embodiments of the invention may be modified or varied, and elements added or omitted, without departing from the invention, as appreciated by those skilled in the art in light of the above teachings. It is therefore to be understood that, within the scope of the claims and their equivalents, the invention may be practiced otherwise than as specifically described.

PARTS LIST

12. Drive circuit
13. Drive signal
14. Ultrasonic transmitter
16. Ultrasonic signal
17. Ultrasonic signal
18. Document feed path
20. Ultrasonic receiver
21. Processed signal
23. Electric signal
24. Phase comparator
26. Amplitude measurement circuit
28. Information signal
32. Microprocessor
22. Analyzer
30. Amplitude information signal
34. Document feeding device
36. Contact glass
38. Copy machine
40. Tray
42. Slit glass
44. Side fences
46. Push up plate
48. Feeding belt
50. Roller
52. Roller
54. Feeding path
56. Rollers
58. Discharge rollers
60. Tray
150. Clock
152. PLD
154. Counter
156. Register

What is claimed is:

1. A method for detecting wrinkling of sheets of material, comprising:

a) transporting the sheet of material along a feed path;

b) arranging a transmitter at a pre-determined angle to the feed path;

c) sending a signal from the transmitter through the feed path and the sheet as it passes the transmitter;

d) detecting changes in an angle of a paper with respect to the signal;

e) determining the sheet is wrinkling based on the changes in the angle;

wherein step d) comprises:

receiving the signal after it passes through the sheet;

comparing a phase of the received signal with a base phase; and determining the change in the angle based on the comparison of the phases.

2. The method of claim 1 wherein the base phase is a phase of the transmitted signal.

3. The method of claim 1, further comprising halting transport of the sheet when wrinkling is detected.

4. A method for detecting wrinkling of sheets of material, comprising:

a) transporting the sheet of material along a feed path;

b) arranging a transmitter at a predetermined angle to the feed path;

c) sending a signal from the transmitter through the feed path and the sheet as it passes the transmitter;

d) detecting changes in an angle of a paper with respect to the signal;

e) determining the sheet is wrinkling based on the changes in the angle;

wherein step d) comprises:

receiving the signal after is passes through the sheet;

comparing a amplitude of the received signal with an amplitude of the transmitted signal; and determining the change in the angle based on the comparison of the amplitudes.

5. In a document transport system that transports a document along a feed path, a method of detecting document jams, the method comprising:

determining a desired angle the document forms with the feed path during normal operation;

detecting an actual angle the document forms with the feed path;

determining a difference between the desired angle and the actual angle;

a document jam when the difference exceeds a predetermined threshold;

impinging an ultrasonic signal on the document;

receiving a portion of the impinged signal after it passes through the document;

determining at least one of a phase difference and an amplitude difference between the impinged signal and the impinged signal after it passes through the document; and determining if the document is wrinkled based on at least one of the phase difference and the amplitude difference.

6. The method of claim 5, wherein the difference is detected at selected points along the feed path.

7. A method of detecting wrinkling of sheets of material, comprising:

a) transmitting a signal through the sheet;

b) receiving the signal after it has passed through the sheet;

c) comparing the generated signal to the received signal; and d) detecting wrinkling in the sheet based on the comparison.

8. The method of claim 7, wherein step c) comprises comparing a phase of the transmitted signal with a phase of the received signal.

9. The method of claim 7, wherein step c) comprises comparing an amplitude of the transmitted signal with an amplitude of the received signal.

10. The method of claim 7, wherein step c) comprises:

comparing an amplitude of the transmitted signal with an amplitude of the received signal;

generating a first information signal based on the amplitude comparison;

comparing a phase of the transmitted signal with a phase of the received signal;

generating a second information signal based on the phase comparison; and analyzing the first and second information signals to determine if the sheet is wrinkled.

11. The method of claim 10, further comprising:

converting the received signal to an electrical signal;

providing the electrical signal to a phase comparator;

providing a drive signal to the phase comparator; and generating the second information signal with the phase comparator based on the drive signal and the electrical signal.

12. The method of claim 10, further comprising:

converting the received signal to a first electrical signal;

providing the first electrical signal to an amplitude measurement circuit;

generating a second electrical signal corresponding to the transmitted signal;

providing the second signal to the amplitude measurement circuit; and generating the first information signal with the amplitude measurement circuit based on the first and second electrical signals.

13. The method of claim 10, further comprising:

applying a first weighting factor to said first information signal and applying a second weighting factor to said second information signal before analyzing said first and second information signals with said first and second weighting factors, respectively, to determine if said sheet is wrinkled.

14. The method of claim 7, wherein the signal is an ultrasonic signal.

15. The method of claim 7, further comprising:

determining a phase of the transmitted signal;

determining a phase of the received signal;

determining a phase difference between the phase of the transmitted signal and the phase of the received signal; and detecting wrinkling when the phase difference exceeds a pre-determined limit.

16. The method of claim 7, further comprising:

determining an amplitude of the transmitted signal;

determining an amplitude of the received signal;

determining an amplitude difference between the amplitude of the transmitted signal and the amplitude of the received signal; and detecting wrinkling when the amplitude difference exceeds a pre-determined limit.

17. In a mechanism for feeding sheets of material, a method for detecting wrinkling of the sheets, comprising:

feeding a sheet with the mechanism along a feed path;

transmitting a signal through the sheet as it passes along the feed path;

receiving the signal after it passes through the sheet;

detecting a phase difference between the transmitted signal and the received signal;

detecting an amplitude difference between the transmitted signal and the received signal;

determining if the sheet is wrinkling based on at least one of the phase difference and the amplitude difference; and halting the feeding of the sheet if it is determined the sheet is wrinkling.

18. A method of detecting wrinkling of sheets, comprising:

producing a first electrical signal;

producing an ultrasonic signal that impinges on the sheet at a position along a feed path;

receiving a portion of the ultrasonic signal that impinged upon the sheet;

producing a second electrical signal in response to receiving the ultrasonic signal;

comparing the first and second electrical signals; and analyzing the first and second electrical signals to determine if the sheet is wrinkled.

19. The method of claim 18, wherein the analyzing step comprises determining the sheet is wrinkled when at least one of a difference between the first electrical signal and a first predetermined value, a difference between the second electrical signal and a second predetermined value, and a combination of both differences between the first and second electrical signals exceeds a threshold.

20. The method of claim 18, further comprising applying a first weighting factor to said first electrical signal and applying a second weighting factor to said second electrical signal before analyzing said first and second electrical signals with said first and second weighting factors, respectively, to determine if said sheet is wrinkled.

21. An apparatus for detecting wrinkling documents, comprising:

an ultrasonic transmitter for transmitting a signal;

an ultrasonic receiver receiving the signal;

a phase comparator for comparing the transmitted signal and the received signal;

an amplitude measurement circuit for comparing the transmitted signal and the received signal; and a microprocessor communicating with the phase comparator and the amplitude measurement circuit to determine if the document is wrinkled.

* * * * *